United States Patent [19]

Crawford et al.

[11] Patent Number: 4,715,441

[45] Date of Patent: Dec. 29, 1987

[54] SIDE POCKET MANDREL

[76] Inventors: Douglass W. Crawford; William B. Crawford, both of P.O. Box 51, Atwood Akers, Crowley, La. 70526; Mark S. Crawford, 501 Kaiser Dr., Lafayette, La. 70508

[21] Appl. No.: 789,313

[22] Filed: Oct. 18, 1985

[51] Int. Cl.[4] ..... E21B 23/03

[52] U.S. Cl. ..... 166/117.5; 417/111

[58] Field of Search ..... 166/117.5, 117.6; 417/109, 110, 111

[56] References Cited

U.S. PATENT DOCUMENTS

| | | | |
|---|---|---|---|
| 2,368,407 | 1/1945 | Boynton | 417/111 |
| 2,988,146 | 6/1961 | Fredd | 166/117.5 |
| 3,654,949 | 4/1972 | McMurry | 417/109 |
| 3,741,299 | 6/1973 | Terral | 166/117.5 |
| 4,105,279 | 8/1978 | Glotin et al. | 166/117.5 |
| 4,416,330 | 11/1983 | Merritt et al. | 166/117.5 |
| 4,440,222 | 4/1984 | Pullin | 166/117.5 |
| 4,501,323 | 2/1985 | Lively et al. | 166/117.5 |
| 4,524,831 | 6/1985 | Pringle | 166/117.5 |
| 4,541,482 | 9/1985 | Johnston | 166/117.5 |

*Primary Examiner*—James A. Leppink
*Assistant Examiner*—Terry Lee Melius
*Attorney, Agent, or Firm*—Dodge, Bush & Moseley

[57] ABSTRACT

In accordance with an illustrative embodiment of the present invention, a side pocket mandrel includes a tubular main body having an internal bore, a seating section w4elded to one end of said main body and having a main bore and a laterally offset seating bore opening to the exterior thereof, the axis of said seating bore being inclined at a small angle toward the axis of said main bore, said seating bore having a polish section at the outer end thereof and a latch shoulder adjacent the inner end of said polish section, and a gas flow opening communicating said seating bore with said main bore at a location inwardly of said polish section. A tubular member having an orienting sleeve therein is welded to said seating section in alignment with said main bore, and a swage nipple is welded to the opposite end of said main body. All of said welds are transverse to provide a high strength and compact mandrel assembly.

20 Claims, 6 Drawing Figures

SIDE POCKET MANDREL

FIELD OF THE INVENTION

This invention relates generally to side pocket mandrels used in wells on gas lift, and particularly to a new and improved side pocket mandrel having a gas lift valve seating section that is constructed in a manner such that the overall mandrel assembly is very compact and has high strength.

BACKGROUND OF THE INVENTION

Devices called side pocket mandrels have been used for many years in the production of oil wells where formation fluids are brought up to the surface by an artificial lift technique known as "gas lift". To employ this technique, a gas is pumped into the tubing-casing annulus and enters the bore of the tubing downhole via a gas lift valve that is positioned within the belly of a side pocket mandrel. The gas mixes with the formation fluids in the tubing and lightens the weight of the fluid column so that the natural bottom-hole pressure of the well is sufficient to force the fluids out of the top of the tubing in an artesian manner. Typically the lift gas is recovered at the surface in a separator, and then reinjected into the annulus.

A side-pocket mandrel that has become very common in the industry is the design offered by Camco, Inc., Houston, Tex. This device has an internal side pocket that is laterally offset from the open bore therethrough, and the pocket has upper and lower, spaced-apart polish bores which receive the spaced packing assemblies on a gas lift valve. The side pocket body usually is a finished assembly that is welded into a window cut out of the side of the mandrel. To prevent other well devices that might be lowered through the tubing from hanging up on the pocket, a deflector-guide assembly also is welded into a window cut out of the mandrel above the side pocket. An example of a mandrel of this construction may be seen in FIG. 2 of U.S. Pat. No. 3,741,299, issued June 26, 1973.

The resulting mandrel design of the type described is a very lengthy and expensive assembly that incorporates a number of vertical and transverse welds which have been sources of failure, particularly when the mandrel is subjected to high burst or collapse pressures. Such welds also substantially increase manufacturing cost and consumer price. The use of an internal pocket totally enclosed within the mandrel body also results in a lengthy and expensive mandrel, and produces operational problems in using a kickover tool to set or remove gas lift valves.

The general object of the present invention is to provide a new and improved side pocket mandrel having a construction which obviates the above-mentioned problems.

Another object of the present invention is to provide a new and improved side pocket mandrel having a valve seating section of the same transverse dimension as the main body of the mandrel to strengthen the same while substantially reducing the overall length and manufacturing cost of the mandrel.

Another object of the present invention is to provide a new and improved side pocket mandrel having a short-length seating section welded therein which receives and latches a gas lift valve, and which protects the latch from being hit by other well devices.

SUMMARY OF THE INVENTION

These and other objects are attained in accordance with the present invention through the provision of a side pocket mandrel having a main body section with a hollow interior. One side of the hollow interior provides an open bore that is aligned with the bore of the tubing in which the mandrel is to be connected, and the opposite side of the hollow interior is arranged to receive the kickover arm and attached valve of a gas lift valve installation apparatus (commonly called a "kickover tool").

A short length seating section having the same outside peripheral outline or shape as the main body section, is welded to one end of the main body section and includes a polish bore that opens to the outside of the mandrel, and a latch shoulder adjacent the inner end of said polish bore. An open bore that extends alongside the polish bore is aligned with the axis of the tubing, and an elongated radial recess communicates with the polish and open bores to permit gas that is injected via the lift valve that is latched into the polish bore to enter the open bore through said recess. A tubular member having threads for connecting to the tubing is welded to the seating section in alignment with said open bore, and may have a "mule shoe" type orienting sleeve formed or positioned within the interior thereof. A swage nipple is welded to the opposite end in the main body section and can have a ramp means located therein which cooperates with the kickover tool arm assembly to align the nose of the gas lift valve with the polish bore in the seating section.

Since the welds that secure the seating section to the body section and to the tubular member are both transverse, no longitudinal welds are required. The seating section is a short-length structure that minimizes the overall length of the mandrel assembly, and makes the same very compact.

BRIEF DESCRIPTION OF THE DRAWINGS

The present invention has other objects, features and advantages that will become more clearly apparent in connection with the following detailed description of a preferred embodiment, taken in conjunction with the appended drawings in which.

DETAILED DESCRIPTION OF A PREFERRED EMBODIMENT

Figure 1A:
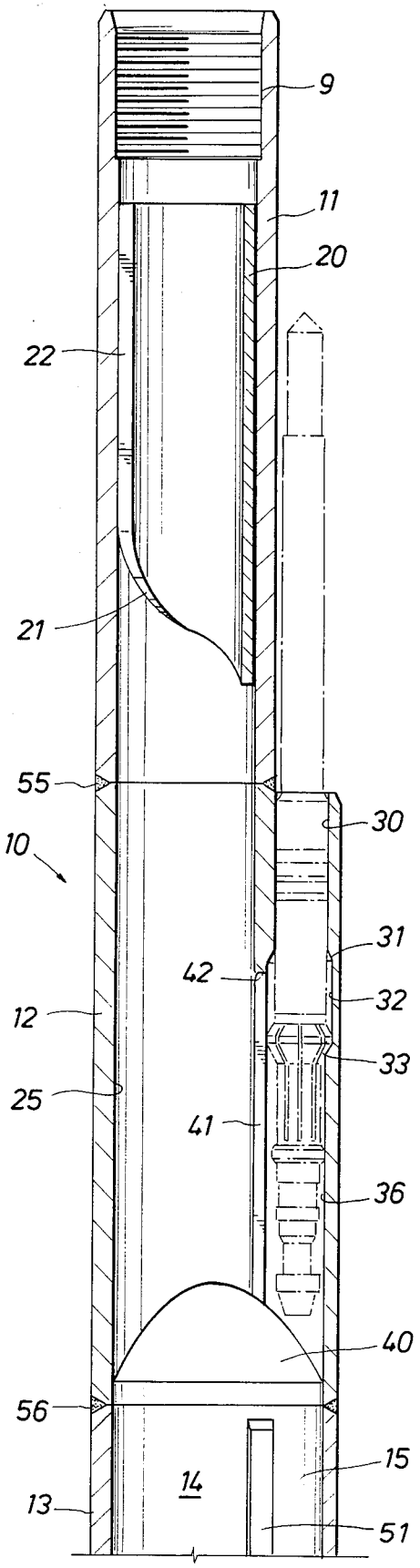
FIGS. 1A and 1B are longitudinal sectional views of a side pocket mandrel that is constructed in accordance with this invention.

Referring initially to FIG. 1, a side pocket mandrel assembly indicated generally at 10 includes an upper tubular member 11 having internal threads 9 for connecting the same to a string of production tubing (not shown). The tubular member 11 is secured by a transverse weld 55 to a seating section 12 of relatively short length, and the section 12 is secured by a transverse weld 56 to a main body section 13. The main body section 13 preferably is circular in cross-section, and one side 14 of the hollow interior thereof is axially aligned with the bore of the tubular member 11. The other side 15 of the hollow interior provides an elongated space for operation of the kickover arm of a gas lift valve setting or retrieving tool, such arm being typically a segmented subassembly that can be pivoted outward in order to align a valve attached to the end thereof for insertion into a valve seat or pocket in the mandrel. The lower end of the main body section 13 is secured by a transverse weld 57 to a swage nipple 16 that has internal threads 17 for connection to the tubing.

As shown in FIG. 1A, the tubular member 11 can have an orienting sleeve 20 fixed within the bore thereof. The sleeve 20 has a pair of helical lower surfaces 21 that lead upward to an elongated vertical slot 22. The slot 22 is arranged to receive a key on a setting tool as it is moved upward therethrough, in order to rotationally orient the tool in a manner such that the kickover arm and valve are generally aligned within the region 15 of the body section 13. Such orientation is achieved by the fact that the key will first encounter one of the inclined surfaces 21 and be guided thereby into the slot 22. A second key that initially is vertically misaligned with the first-mentioned key will then encounter one of the surfaces 21 during continued upward movement, and the camming action as the keys are forced into vertical alignment achieves proper orientating and causes the kickover tool to trigger the release of guide rollers or wings on the arm assembly in the manner disclosed in detail in U.S. patent application Ser. No. 679,263, filed Dec. 7, 1984. The wings then cause the inwardly biased arm assembly to be pivoted outward during continued upward movement.

Figure 2:
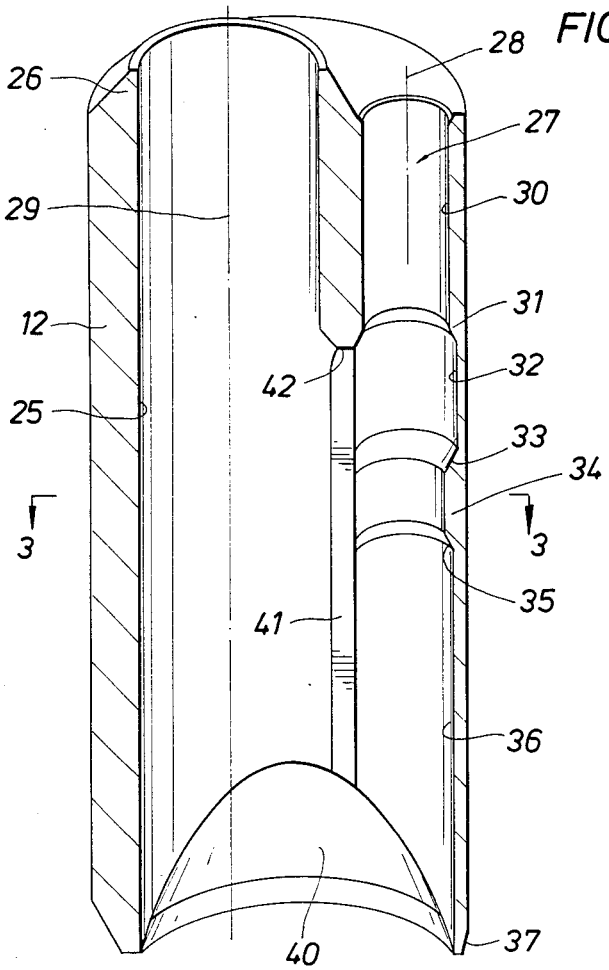
FIG. 2 is a three-dimensional view of the valve seating section of FIG. 1A.
Figure 3:
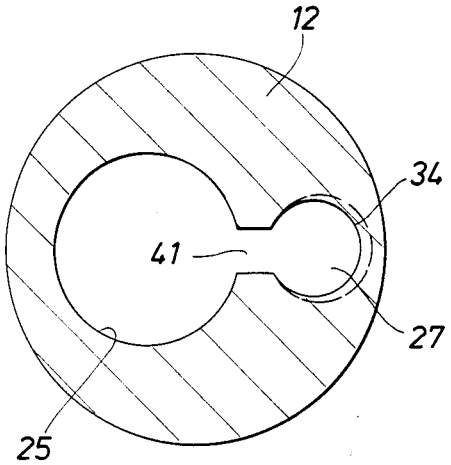
FIG. 3 is a cross-section taken on line 3—3 of FIG. 2.

The seating section 12 of the present invention is shown in detail in FIG. 2 and 3. The section 12 is generally tubular, and has a main bore 25 machined to one side thereof. The upper end of the bore 25 opens through an annular lip 26 which is chamfered to facilitate welding to the lower end of the tubular member 11. Another bore 27 is formed on the opposite side of the section 12, and has its central axis 28 slightly inclined downward and inward with respect to the axis 29 of the main bore 25. The angle of inclination may be, for example, from 1½° to 3°. The upper end portion 30 of the bore 27 has a reduced diameter (for example 1.125 inches), and is machined as a polish bore that receives an annular packing assembly of a gas lift valve or other flow control device shown in phantom lines in FIG. 1A. The bore 30 opens to the outside of the mandrel at its upper end as shown, and is joined by an annular inclined surface 31 to a larger diameter bore 32 which receives the latch element (for example collet) of a typical latch assembly which releasably connect the gas lift valve, or other flow control device, in place. The latch element has shoulder surfaces that engage an inclined shoulder 33 at the lower end of the enlarged bore 32, and the shoulder 33 forms the upper side of an inwardly directed flange 34 that has another inclined annular shoulder 35 at its lower side. The shoulder 35 is at the upper end of another enlarged diameter bore 36 that opens through the lower end surfaces 40 of the section 12. The lower end of the section 12 is beveled at 37, again to facilitate welding to the upper end of the main body section 13.

A generally frusto-conical surface 40 is machined in the lower portion of the section 12 as shown, and a vertical slot 41 is milled out in the wall that separates the bores 30 and 25 in order to provide for the inward flow of lift gas. The slot 41 extends upward to a point 42 adjacent the "no go" shoulder 31, and preferably has a width such that the latch shoulder 33 extends circumferentially through an angle of about 290° (145° to either side of a radial line that intersects the respective centerlines of the bores 28 and 29) to provide ample stop surface area for the latch element. The slot 41 also functions as a guide for proper rotational orientation of the body of the gas lift valve to radially align a port in the neck of the valve such that the lift gas is injected into the bore 25 where it is admixed and entrained in the upward flow of production fluids.

If desired, the central bore 25 may have a transverse dimension of, for example, 2.750 inches up to an inclined surface 43 where the diameter is reduced to 2.441 inches, which is the same dimension as the inner diameter of the orienting sleeve 20. Of course, these dimensions are applicable to a typical size side pocket mandrel, for example a mandrel sized to be connected in a 2⅞" o.d. tubing string.

Figure 1B:
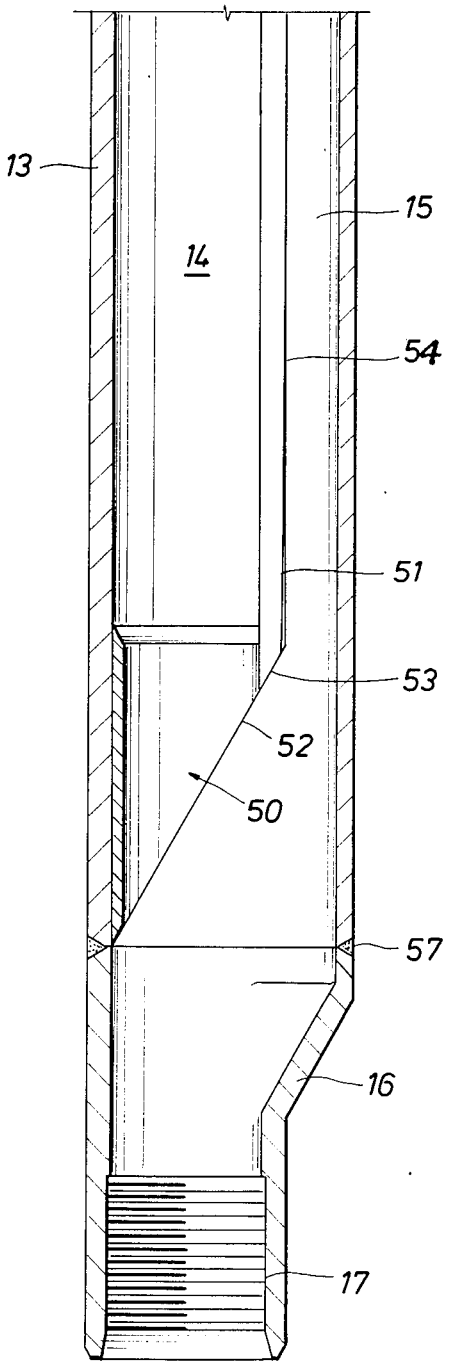

The swage nipple 16 shown in FIG. 1B has fixed therein a ramp member 50 that is generally semi-circular in section and has inclined surfaces 52 on opposite sides thereof. The upper and lower ends of the member 50 can be oppositely inclined, as shown, so that no transverse shoulders are formed which could cause other tools to hand up on the member. If desired, a pair of oppositely disposed, elongated rails 51 are mounted inside the main body section 13 between the bore 14 and the region 15, in positions such that outwardly facing surfaces 54 thereof are generally vertically aligned with the innermost surface of the seating bore 30. The lower end of each rail 51 may be inclined at 53 to present a continuous ramp surface, and the upper end of each rail can terminate at approximately the upper end of the body section 13.

As shown in the drawings, the tubular member 11 is joined to the upper end of the receptacle section 12 by the transverse weld 55, and the lower end of the receptacle section 12 is joined to the upper end of the body section 13 by the transverse weld 56. The lower end of the body 13 is joined to the swage nipple by a transverse weld 57. It will be noted that there is a total absence of any vertical weld seams, or any partial transverse seams, which is a feature that greatly simplifies the manufacture of the mandrel, and provides a structure that is very compact and has high strength.

Figure 4:
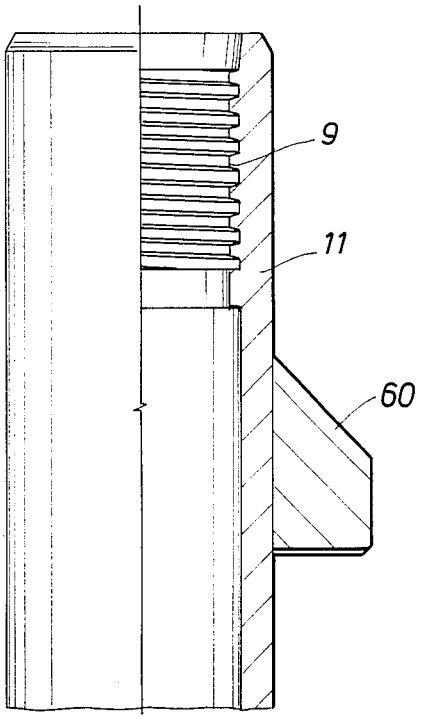
FIGS. 4 and 5 show modifications of the mandrel of the present invention.

In a modification of the present invention as shown in FIG. 4, a guard lug 60 may be fixed to the outside of the tubular member 11 at a distance from the upper end of the section 12 such that it is closely adjacent the nose of the gas lift valve when the valve is latched in place. Thus arranged, the lug prevents the valve from being damaged in the event the tubing is moved upward in the casing while the valve is in place.

Figure 5:
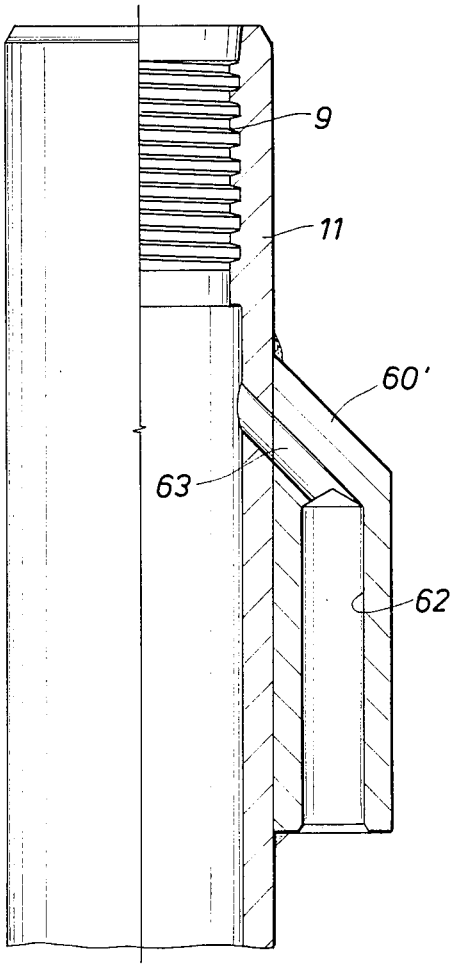

In a further modification of the present invention shown in FIG. 5, the guard lug 60' may have a polish bore 62 formed therein on a diameter that is slightly less than the diameter of the bore 30, for example 1.000 inch. A gas flow port 63 communicates the polish bore 62 with the interior bore of the tubular member 11. This feature enables a more conventional gas lift valve to be used having spaced apart packing rings that engage the respective bores 30 and 61, and a gas outlet port through the end of the nose thereof which is packed off in the bore 62.

Having disclosed the principle components of the present invention, it will be apparent to those skilled in this art that these components could be rearranged from that shown in the drawing without departing from the concepts of the present invention. For example, the member 12 which houses an orienting sleeve 20 could be attached to a swage nipple and body section as previously described, except inverted, or turned upside-down. With this configuration of parts, the seating section 13 would be inverted also and would be located near the lower end of the mandrel, whereby the polish bore 30 would open downward. Of course the tubular member to which the section 13 is welded, in this configuration, would not have an orienting sleeve therein.

In another configuration, the entire assembly as shown in FIGS. 1A and 1B could be inverted, and the position of the orienting sleeve 20 reversed so that the guide surfaces would still lead in the upward direction to the slot. In any of these configurations, the guard lug, with or without polish bore and gas port, could be used.

It now will be recognized that a new and improved side pocket mandrel having a short length and increased strength has been disclosed. Since certain changes or modifications may be made in the disclosed embodiments without departing from the inventive concepts involved, it is the aim of the appended claims to cover all such changes and modifications falling within the true spriit and scope of the present invention.

What is claimed is:

1. A side pocket mandrel comprising: a tubular body section having a hollow interior that defines a main bore to one side thereof and another bore to the other side thereof; a short-length seating section welded to one end of said body section, said seating section having a main bore formed to one side thereof aligned with said main bore in said body section, and a valve seating bore formed on the other side thereof generally aligned with said other bore, said seating bore having a polish section adjacent its outer end, said outer end opening through an exterior end surface of said mandrel, said seating bore having a recessed section adjacent said polish section, said recessed section providing an inwardly facing stop shoulder at one end thereof and a latch shoulder at the other end thereof facing said stop shoulder; and a tubular member welded to said seating section in axial alignment with said main bores, the axis of said polish section of said seating bore being inclined toward the axes of said main bores at a small angle.

2. The mandrel of claim 1 wherein said seating section includes an elongated slot located inwardly of said polish section and arranged to communicate said recessed section with said main bore to permit the passage of gas.

3. The mandrel of claim 1 wherein said latch shoulder has a generally annular shape and extends through an angle of approximately 145° to either side of a radial line that intersects the axes of said main bores and the axis of said polish section of said seating bore.

4. The mandrel of claim 1 further including a generally frusto-conical surface formed on the inner end surfaces of said seating section, said surface having its greatest radial dimension adjacent the inner end of said seating section.

5. The mandrel of claim 4 wherein said latch shoulder is located a distance from the intersection of said seating bore with said frusto-conical surface such that a latch means engaged with said shoulder does not protrude beyond said surface.

6. The mandrel of claim 1 further including an orienting sleeve fixed within said tubular member, said tubular member having thread means for connecting said mandrel in a tubing string.

7. The mandrel of claim 6 further including swage nipple means welded to the other end of said body section and having thread means for connecting said mandrel in a tubing string.

8. The mandrel of claim 7 further including ramp means fixed adjacent said swage means and having inclined surface means on opposite sides thereof.

9. The mandrel of claim 8 further including guide means extending longitudinally along inner wall surfaces of said body section from said inclined surface means to a location adjacent the inner end of said seating bore.

10. The mandrel of claim 8 wherein said ramp means comprises a member that is generally semi-circular in transverse cross-section, and has inwardly inclined surfaces at the opposite ends thereof.

11. The mandrel of claim 9 wherein said guide means includes a pair of rails attached to said inner walls at a location between said main bore and said other bore.

12. The apparatus of claim 1 further including guard means on the exterior of said tubular member spaced a selected distance from, and aligned with, said polish section opening.

13. The apparatus of claim 12 wherein said guard means has another polish bore formed in the interior thereof, and further including gas flow port means for communicating said other polish bore with the interior of said tubular member.

14. A body section adapted to be incorporated in a side pocket mandrel and to receive a well flow control device, comprising: a generally tubular body having a main bore extending therethrough with its centerline located to one side of the centerline of said body, and a seating bore extending through said body with its centerline located to the other side of said centerline of said body, the said axis of said seating bore being inclined at a small angle toward the axis of said main bore, said seating bore having a polish section opening through one end surface of said body, a recessed section having a diameter greater than the diameter of said polish section and providing an inwardly facing stop shoulder adjacent the inner end of said polish section, and an axially spaced latch shoulder opposing said stop shoulder.

15. The body section of claim 14 wherein said body has an interior wall providing a separation of said seating bore from said main bore, and further including a flow opening in said wall for communicating said seating bore with said main bore at a location inwardly of said polish section.

16. The body section of claim 15 wherein said flow opening is formed by an elongated slot extending through the wall of said body section which separates said seating bore and said main bore.

17. The body section of claim 14 further including an outwardly extending lip on the outer end of said body section and surrounding the opening of said main bore, said lip having a chamfer on its outer surface to facilitate welding.

18. The body section of claim 17 further including a generally frusto-conical surface on the inner end thereof, said surface having its greatest radial dimension adjacent said inner end.

19. The body section of claim 18 wherein the distance between said latch shoulder and the intersection of said bore with said frusto-conical surface is selected such that a latch apparatus engaged with said latch shoulder does not extend beyond said surface.

20. The body section of claim 14 wherein said latch shoulder extends annularly for approximately 145° to either side of a radial line intersecting the axis of said seating bore and the axis of said main bore.

* * * * *